US005399801A

United States Patent [19]

Hasebe et al.

[11] Patent Number: 5,399,801

[45] Date of Patent: Mar. 21, 1995

[54] ELECTRONIC MUSICAL INSTRUMENT HAVING AN AUTOMATIC STROKE PERFORMANCE FUNCTION

[75] Inventors: Masahiko Hasebe; Yasushi Kurakake, both of Hamamatsu, Japan

[73] Assignee: Yamaha Corporation, Hamamatsu, Japan

[21] Appl. No.: 995,818

[22] Filed: Dec. 23, 1992

[30] Foreign Application Priority Data

Dec. 26, 1991 [JP] Japan ..... 3-344585

[51] Int. Cl.[6] ..... G10H 1/42

[52] U.S. Cl. ..... 84/622; 84/635; 84/636; 84/DIG. 12

[58] Field of Search ..... 84/609–614, 84/622–625, 634–638, 650–652, 659–661, 666–669, 477 R, 478, DIG. 12

[56] References Cited

U.S. PATENT DOCUMENTS 4,757,736 7/1988 Tajima et al. ..... 84/DIG. 12
4,991,486 2/1991 Ito et al. ..... 84/611

FOREIGN PATENT DOCUMENTS 3-2898 1/1991 Japan .

*Primary Examiner*—Stanley J. Witkowski
*Attorney, Agent, or Firm*—Spensley Horn Jubas & Lubitz

[57] ABSTRACT

A desired rhythm instrument tone color can be assigned to a pad type performance operator. A desired type of repeated-tone mode, e.g., roll, flam or echo, can be selected by a switch operation or other suitable means. Upon operation of the performance operator, repeated tones having a rhythm instrument tone color assigned to the performance operator are generated with a stroke pattern having a characteristic peculiar to the tone color.

10 Claims, 8 Drawing Sheets

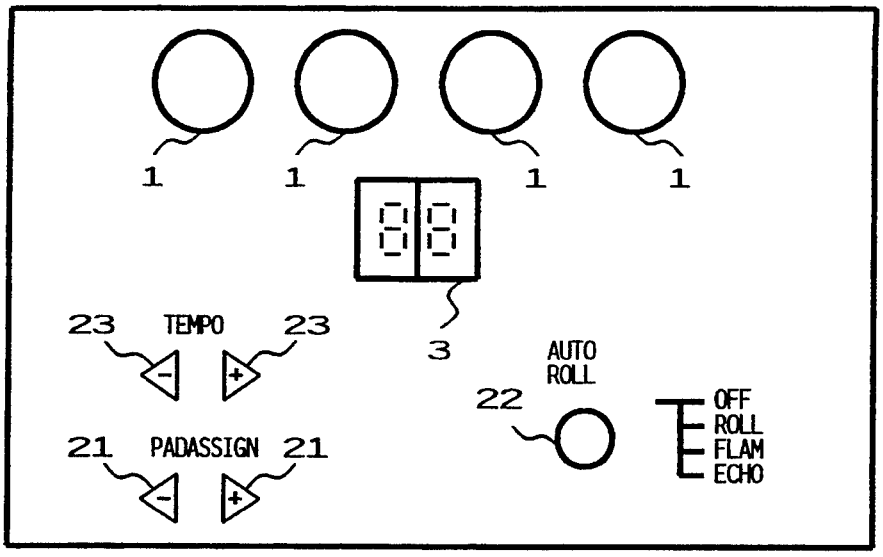
FIG. 2
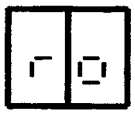
FIG. 3A
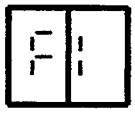
FIG. 3B
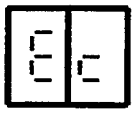
FIG. 3C
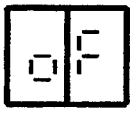
FIG. 3D
| | | TONE COLOR NO. |
|---|---|---|
| SNARE DRUM TONE COLORS | SNARE 1 | 0 |
| | SNARE 2 | 1 |
| | SNARE 3 | 2 |
| CYMBAL TONE COLORS | CYMB 1 | 3 |
| | CYMB 2 | 4 |
| TOM-TOM TONE COLORS | TOM 1 | 5 |
| | TOM 2 | 6 |
| | TOM 3 | 7 |
| | TOM 4 | 8 |
| BASS DRUM TONE COLORS | BASS 1 | 9 |
| | BASS 2 | 10 |
FIG. 4

ELECTRONIC MUSICAL INSTRUMENT HAVING AN AUTOMATIC STROKE PERFORMANCE FUNCTION

BACKGROUND OF THE INVENTION

This invention relates to an electronic musical instrument capable of producing a rhythm tone of a percussion instrument by operation of a performance operator such as a pad.

As basic music performances for producing a vibratory sound by playing a drum, there are a roll performance in which a continuous drum sound is produced by beating a drum repeatedly with a rapid stroke and a flam performance in which an ornament is inserted immediately before a main sound by slightly differing timings of beating a drum with two hands. There are conventionally known electronic musical instruments which produce a drum sound by simulating such roll performance and flam performance.

Among such prior art electronic musical instruments are one disclosed in U.S. Pat. No. 4,991,486 in which a roll performance or flam performance is made by striking a pad while depressing an operator which instructs either the roll performance or the flam performance and one disclosed in Japanese Laid-open Patent Application No. Hei3-2898 in which a roll performance or flare performance is made when a pad is struck with a strength exceeding a certain threshold value.

The prior art electronic musical instruments having the above described function have the advantage that they can readily produce an effect of roll performance or flam performance. In these electronic musical instruments, however, a stroke pattern of a percussion instrument of tones sounded in the roll performance or flam performance is constant and, therefore, it is difficult, in the case of some tone colors to make a performance effect of roll or flam correspondent to such tone colors.

SUMMARY OF THE INVENTION

It is, therefore, an object of the invention to obtain, in an electronic musical instrument producing a rhythm tone of a percussion instrument by operation of a performance operator such as a pad, performance effects by repeated tones of the percussion instrument which correspond to different tone colors.

For achieving the above described object, an electronic musical instrument according to the invention comprises a performance operator, detection means for detecting that the performance operator has been operated, and tone signal generation means responsive to a detection output from said detection means for generating a tone signal representing repeated tones in accordance with a predetermined stroke pattern peculiar to a tone color of the tones.

The tone signal representing repeated tones to be produced in response to the operation of the performance operator is generated on the basis of a repeated stroke pattern exhibiting a characteristic peculiar to a tone color of the tones. Therefore, as the tone color changes, the repeated stroke pattern changes, so that different automatic repeated stroke performances (roll, flam, echo etc.) suitable for respective tone colors are achieved.

A preferred embodiment of the invention will be described below with reference to the accompanying drawings.

BRIEF DESCRIPTION OF THE DRAWINGS

In the accompanying drawings:

FIG. 2 is a diagram showing a part of a panel surface in the electronic musical instrument of FIG. 1;

FIGS. 3A–3D are diagrams showing examples of display by display units in FIG. 2;

FIG. 4 is a diagram showing kinds of tone colors of percussion instrument tone waveforms stored in a tone waveform memory in FIG. 1;

DESCRIPTION OF PREFERRED EMBODIMENTS

Figure 1:
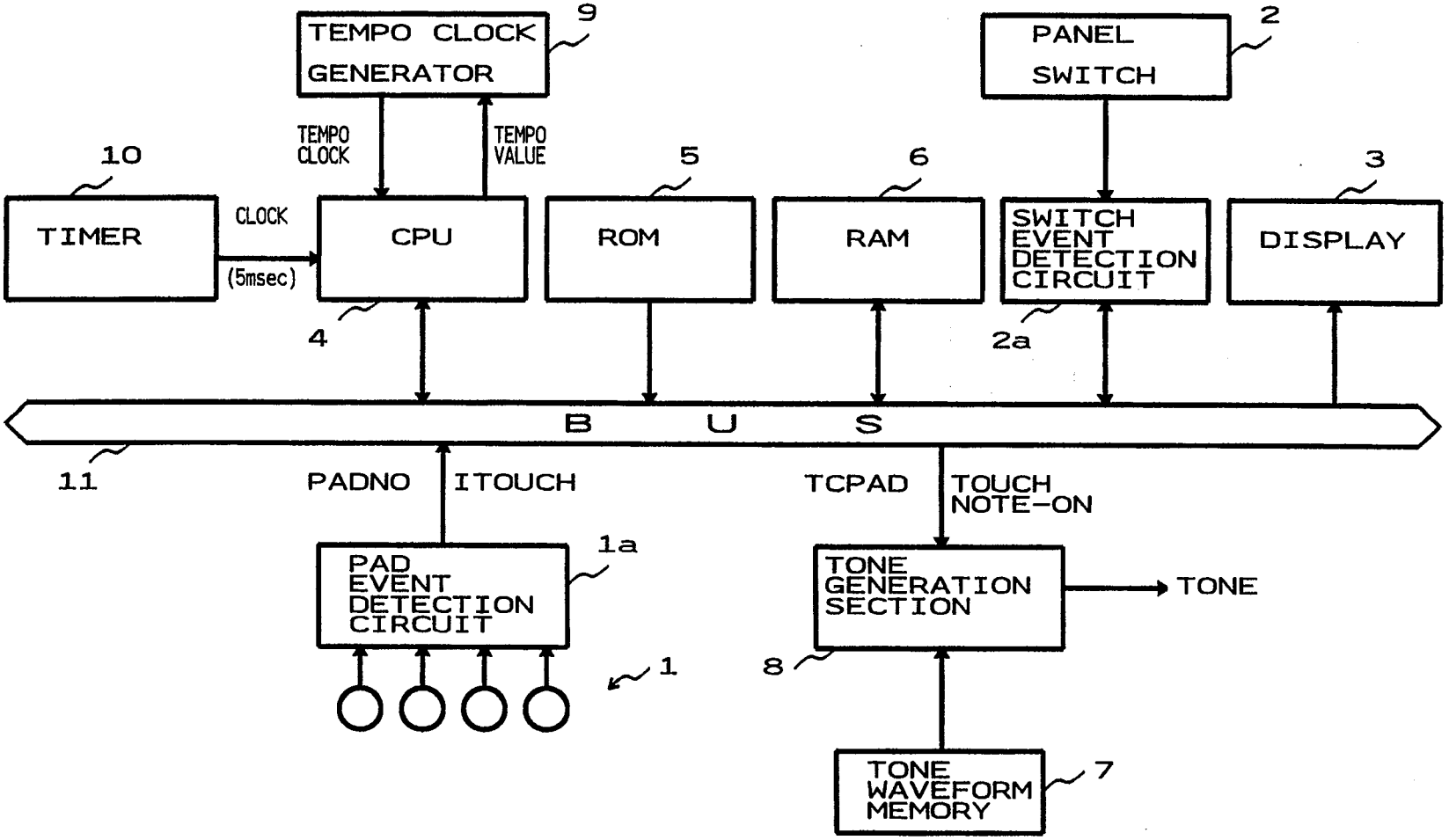
FIG. 1 is a block diagram showing an embodiment of the electronic musical instrument according to the invention.

In the embodiment shown in FIG. 1, the electronic musical instrument includes four pads as shown in FIG. 2 which constitute performance operators. By striking these pads 1, tones of a drum set assigned to the respective pads are generated. By selecting one of automatic roll modes, namely repeated-tone modes, one effect of roll performance, flam performance, and echo performance according to which tones are repeatedly. generated in a decaying manner can be obtained.

A desired tone color can be assigned from a set of tone colors to each of the pads 1 and a stroke pattern of repeated tones which is preset for each tone color can be assigned in a selected automatic roll mode. The electronic musical instrument of this embodiment has an automatic performance function.

A pad event detection circuit la detects each on event in the respective pads 1 and produces pad number data PADNO corresponding to a pad in which the on event has occurred and initial touch data ITOUCH representing speed (i.e., strength) of striking the pad. A switch event detection circuit 2*a* detects a switch operation event in a panel switch 2 and generates a signal corresponding to the detected switch.

The panel switch 2 includes, as shown in FIG. 2, a pad assign switch 21 which is operated when a tone color is to be assigned to the pads 1, an automatic roll switch 22 for turning on and off the automatic stroke performance and also selecting one of the automatic roll means which include a roll performance mode, a flam performance mode and an echo performance mode, a tempo switch 23 for setting tempo of automatic performance and other unillustrated switches.

A display 3 consists of a 7-segment LED (light-emitting diode) and is used for displaying the type of a stroke pattern corresponding to the selected automatic roll mode and also for displaying a rhythm pattern number in the automatic performance.

FIGS. 3A–3D show examples of display by the display 3. When the mode of roll performance is selected, display of FIG. 3A is made. When the mode of flam is selected, display of FIG. 3B is made. When the mode of echo is selected, display of FIG. 3C is made. When the automatic roll mode has been turned off, display of FIG. 3D is made. These displays are changed to display of a tempo value after two seconds.

In FIG. 1, a central processing unit (hereinafter referred to as "CPU") 4 performs a control by using registers and flags established in a random-access memory (hereinafter referred to as "RAM") on the basis of a control program stored in a read-only memory (hereinafter referred to as "ROM") 5 so that the CPU 4 receives information from the pad event detection circuit 1*a* and the switch event detection circuit 2*a* through a bus 11 and supplies tone color number data TCPAD and touch data TOUCH and note-on data to a tone generation section 8 through the bus 11.

A tone waveform memory 7 consists of a ROM which stores, for example, plural kinds of tone color waveform data corresponding to the drum set as shown in FIG. 4.

The memory 7 stores waveform data of three kinds of snare drum tone colors SNARE1–SNARE3, waveform data of two kinds of cymbal tone colors CYNB1 and CYNB2, waveform data of four kinds of tom-tom tone colors TOM1–TOM4 and waveform data of two kinds of bass drum tone colors BASS1 and BASS2. These waveform data of eleven kinds in all are affixed with tone color numbers of "0" to "10" in the order from SNARE1 to BASS2.

The tone generation section 8 including a tone source circuit and a sound system reads out waveform data corresponding to an input tone color number TCPAD from the tone waveform memory 7 and produces a tone of a tone color designated by this tone color number TCPAD with a tone volume corresponding to input touch data TOUCH.

A tempo clock generator 9 generates a tempo clock at a rate of 48 clocks per one beat (crochet) and at a timing corresponding to a tempo value set by the CPU 4. The CPU 4 performs an interruption processing by this tempo clock, thereby to perform a control of interval of repeated tones in the automatic roll mode and to perform a tone generation control in the automatic performance.

A timer 10 generates an interruption clock every 5 msec and the CPU 4 performs a timer interruption processing every 5 msec in response to this interruption clock.

In the ROM 5 are stored a control program, automatic performance pattern data groups, automatic roll sequence data (hereinafter referred to as "sequence data") and an automatic roll sequence address table consisting of head address numbers of respective sequence data.

Figure 5:
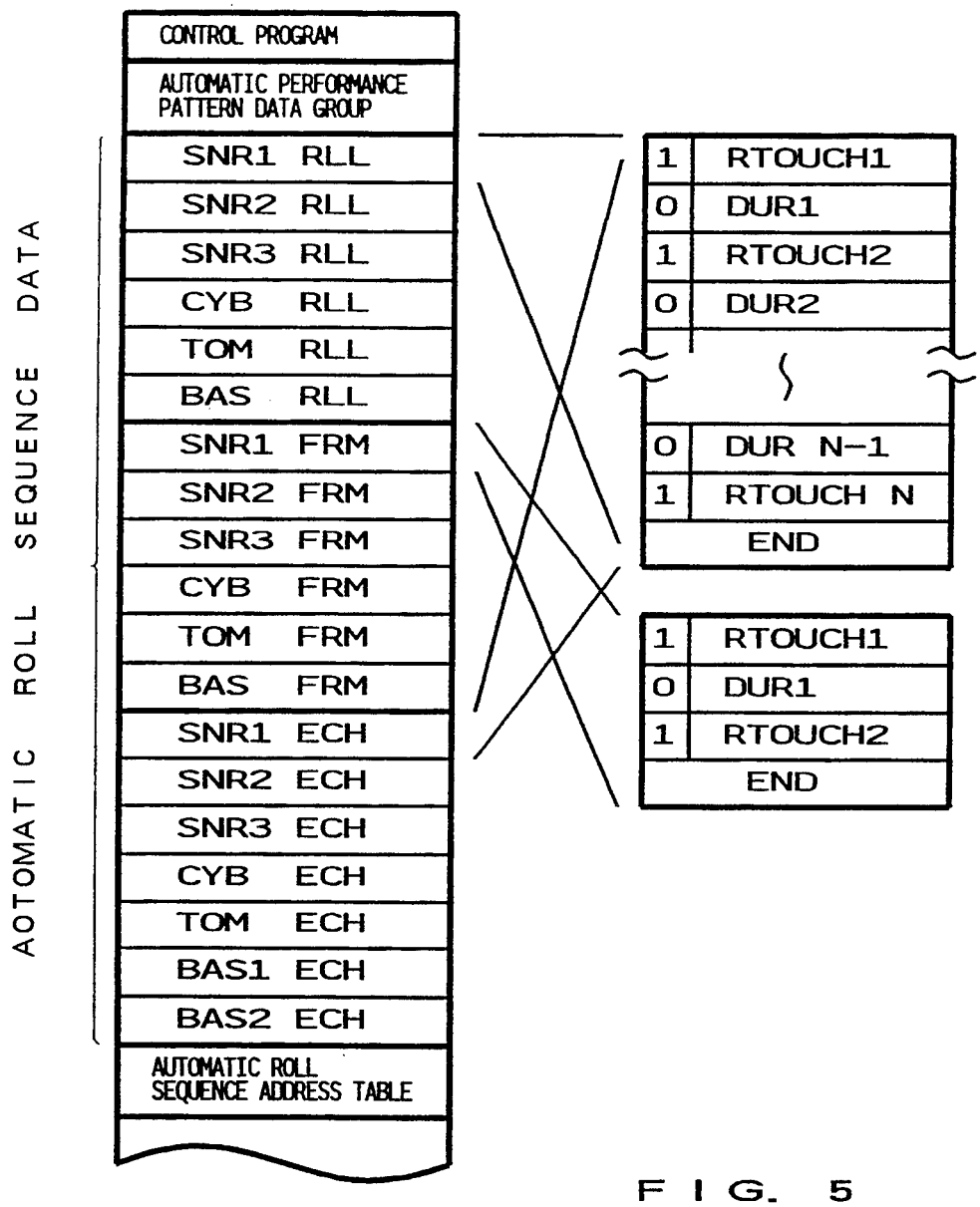
FIG. 5 is a diagram showing contents of storage in a ROM in FIG. 1.

In FIG. 5, "SNR" represents the snare drum tone color, "CYB" the cymbal tone color, "RLL" the stroke pattern of roll performance, "FLM" the stroke pattern of flam performance and "ECH" the stroke pattern of echo performance.

Therefore, in the ROM 5 are stored sequence data of stroke patterns corresponding to the respective tone colors such as "SNR1 RLL" which represents a stroke pattern of roll performance corresponding to a first snare drum tone color and "SNR1FLM" which represents a stroke pattern of flam performance corresponding to a first snare drum tone color.

Each sequence data consists of touch data RTOUCHi representing tone volume of a single stroke tone in the form of ratio to the initial touch ITOUCH1, duration data DURi representing the time interval between respective beats and end data END representing the end of continuous beat tones. The most significant bit of touch data TOUCHi is "1" and the most significant bit of duration data DURi is "0". All bits of end data END are "0".

The sequence data of the roll performance and the echo consist of touch data repeated by the number of beats with the duration data DURi interposed between the respective touch data and the end data END provided at the end. The sequence data of the flam performance consists of touch data TOUCH1 of the first tone and touch data TOUCH2 of the second tone with duration data DUR1 interposed therebetween and the end data END provided at the end of the sequence data.

Figures 6A, 6B, 6C:
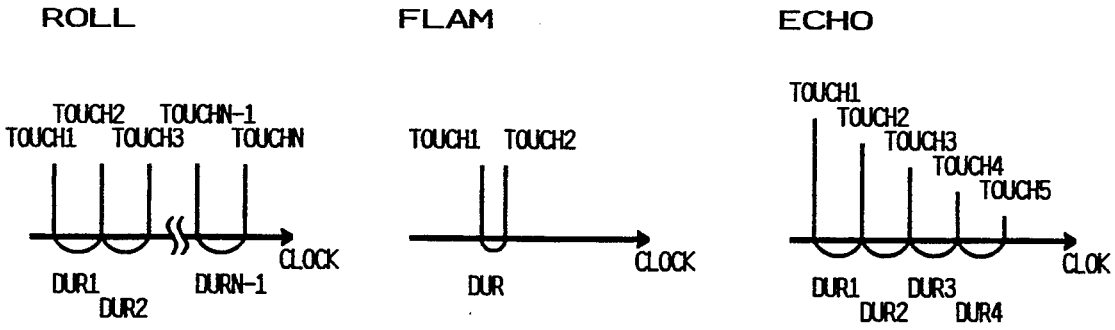
FIGS. 6A–6C are diagrams schematically showing examples of sequence data of a stroke pattern in this embodiment.

As shown schematically in FIGS. 6A–6C, touch data TOUCHi and duration data DURi of the respective sequence data are determined at values corresponding to the respective stroke patterns. FIG. 6A shows sequence data of the roll performance (ROLL), FIG. 6B shows sequence data of the flam performance (FLAM) and FIG. 6C shows sequence data of the echo (ECHO) respectively.

Figure 7:
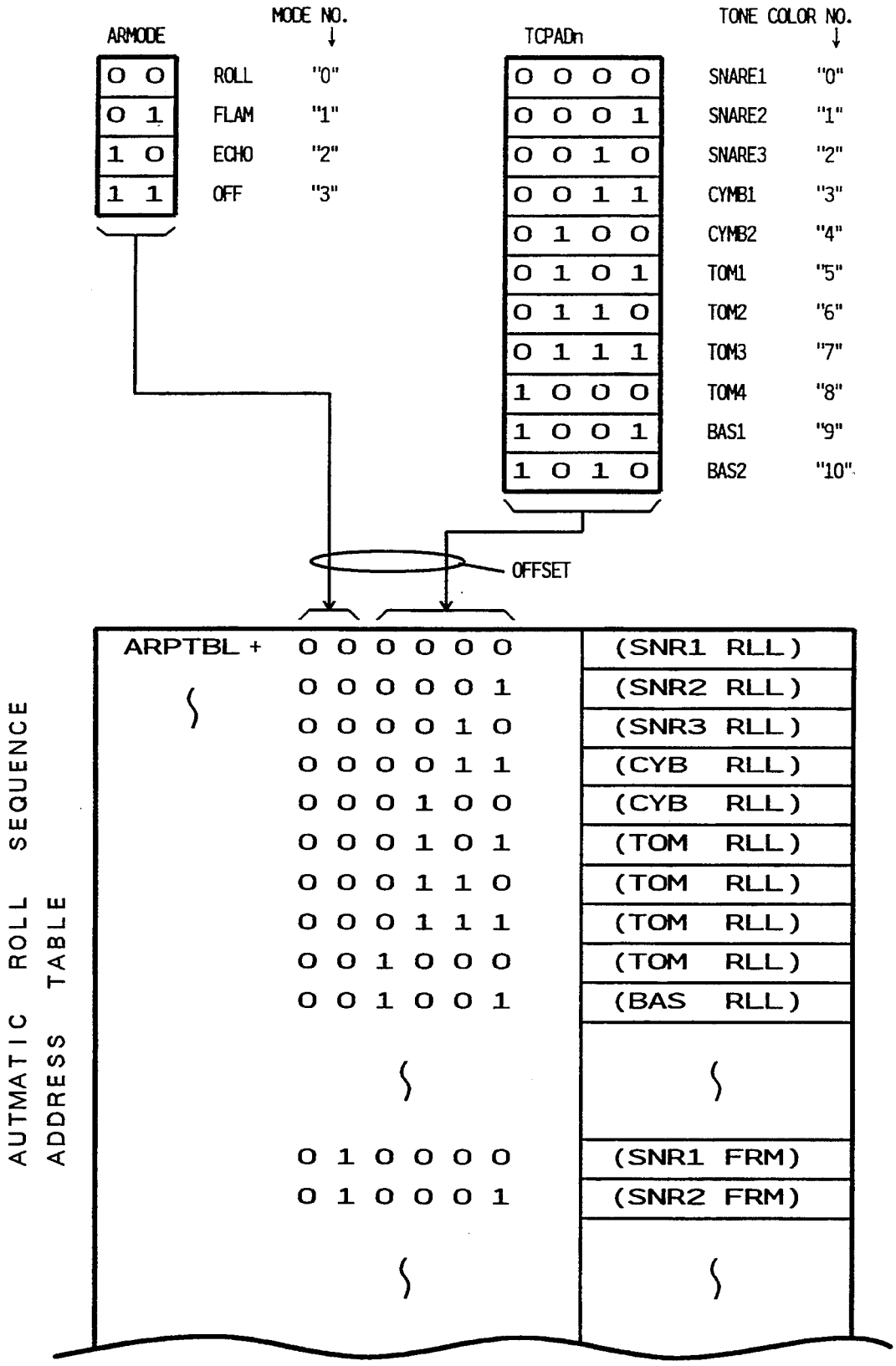
FIG. 7 is a diagram illustrating the relation between an automatic roll sequence address table and mode number and tone color number.

As shown in FIG. 7, states of setting of the roll performance, flam performance and echo in the automatic roll mode and automatic roll mode off (OFF) are stored as mode numbers in a register ARMODE. The respective states of setting are stored as ARMODE=0 at ROLL, ARMODE=1 at FLAM, ARMODE=2 at ECHO and ARMODE=3 at OFF. The tone color numbers of tone colors set to the pads 1 are stored in registers TCPADn (n being 1 to 4) corresponding to the respective pads 1.

Data of 6-bits including 4 bits of the register TCPADn as low order bits and 2 bits of the register ARMODE as high order bits constitutes a relative address number OFFSET to a head address number ARPTBL of the automatic roll sequence address table. By adding this relative address number OFFSET to the head address number ARPTBL, a reference address number of the automatic roll sequence address table is produced.

At each address of the automatic roll sequence address table are stored head address numbers of sequence data corresponding to the tone color number and the mode number constituting the relative address number OFFSET. In this embodiment, as to the cymbal tone color and tom-tom tone color, common sequence data is used for each mode number.

The RAM 6 is of an 8-bit width and has areas for a pad event buffer for temporarily storing a pad number PADNO of a pad 1 in which an on event has occurred and initial touch ITOUCH as well as the following registers and flags used for various controls:

- ARMODE: a register for the mode number indicating the currently set automatic roll mode
- TEMPO: a register for the currently set tempo value
- TCPADn: a register (n=1 to 4) for a tone number assigned to a pad of pad number n
- FLG1: an internal flag (0 or 1) for an automatic roll setting processing FLG2: same as FLG1
DISPTIM: a display switching timer flag
TIMCNT: a display switching timer counter
MODECHG: a flag indicating that a processing for switching the automatic roll mode has started in the automatic roll setting processing (0 or 1)
ARPNTn: an automatic roll sequence counter indicating a read address for sequence data corresponding to a pad of a pad number n
ITOUCHn: a register for storing initial touch in a pad of a pad number n
ARTCn: a register for storing a tone color number of an effect tone to be sounded in the automatic roll for a pad of a pad number n
ARRUNn: an automatic roll start flag corresponding to a pad of a pad number n (0 or 1)

Figure 8:
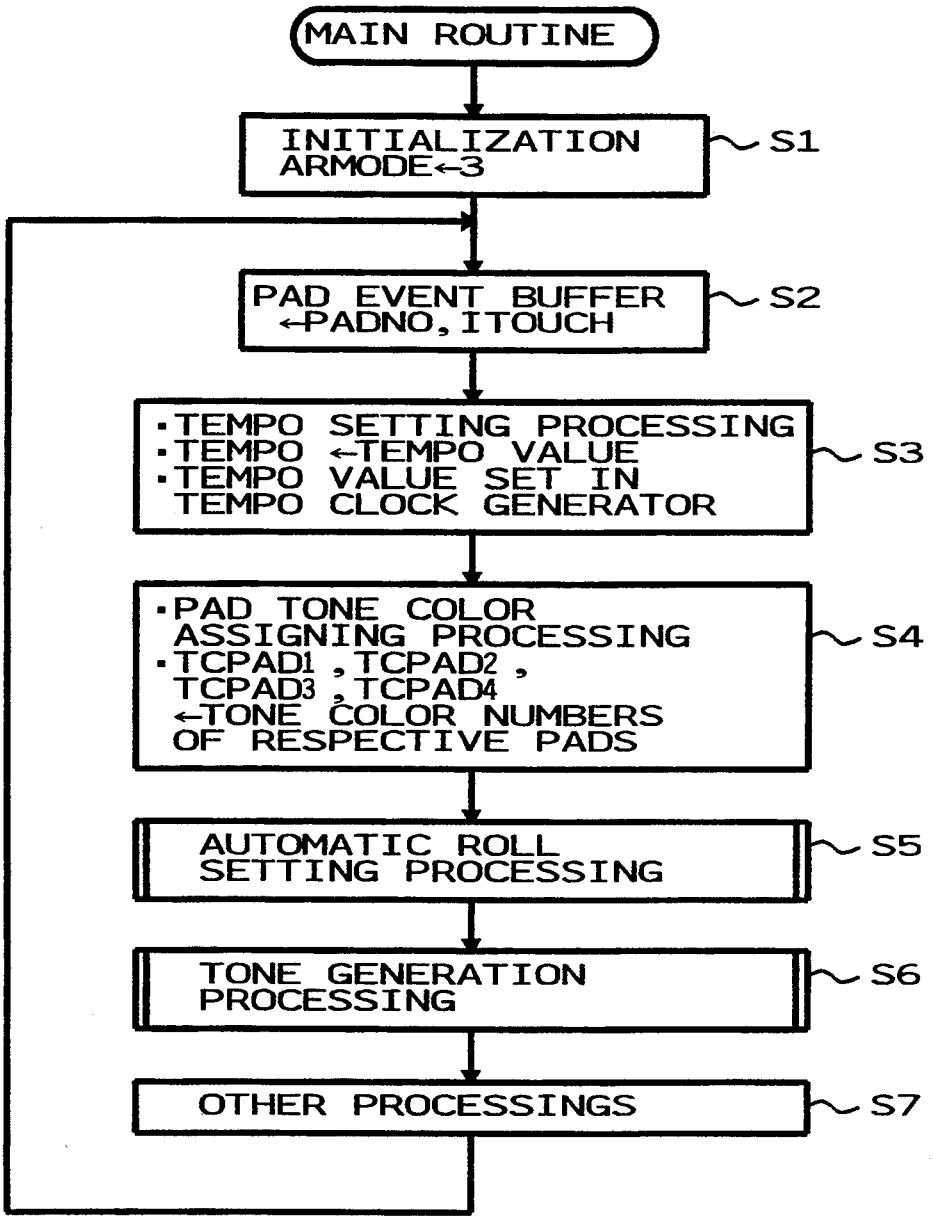
FIG. 8 is a flow chart of a main routine of a control in the embodiment of FIG. 1.

FIG. 8 is a flow chart showing the main routine of the control program and FIGS. 9–12 are flow charts showing subroutines and interruption routines. Operation of the above described embodiment will be described with reference to these flow charts.

In the following description and these flow charts, registers and flags used for the controls are designated by the above described labels and each register or flag and its contents are designated by the same label.

Upon turning on of power, the CPU-4 starts the main routine of FIG. 8. In step S1, initializing of the system such as setup of registers, e.g., setting of ARMODE to "3" and resetting of flags, is performed.

Then, in step S2, the respective pads 1 are scanned in the pad event detection circuit la and the pad number PADNO of a pad in which an on event has occurred and initial touch ITOUCH are stored in the pad event buffer. In step 3, a tempo setting processing is performed for storing a preset value of tempo and a tempo value renewed by operation of a tempo switch 23 in TEMPO and setting this tempo value in a tempo clock generator 9. The tempo clock generator 9 thereby produces a tempo clock corresponding to the set tempo value.

Upon completion of the tempo setting processing, the routine proceeds to step S4 in which a pad tone color assigning processing is performed. The tone color numbers of tone colors designated to the respective pads 1 are set to registers TCPAD1–TCPAD4 corresponding to the respective pads 1. As this pad tone color assigning processing, there is, for example, a method disclosed in Japanese Laid-open Patent Application No. Hei1-177090 according to which a desired tone color is determined by changing the tone color by means of the pad assign switch 21 while listening to a tone which is actually sounded.

Figure 9:
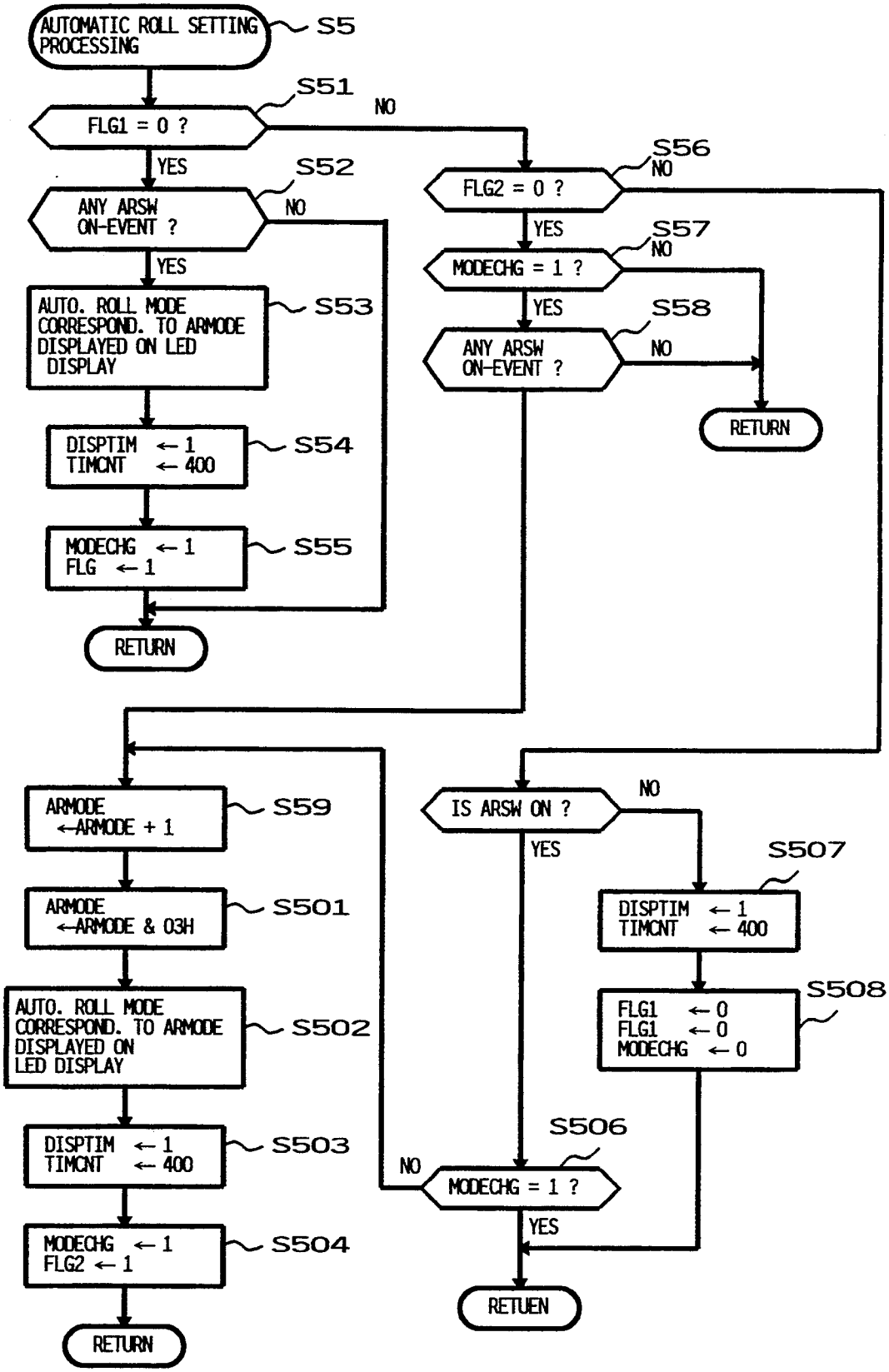
FIG. 9 is a flow chart showing a specific example of an automatic roll setting processing in FIG. 8.
Figure 12:
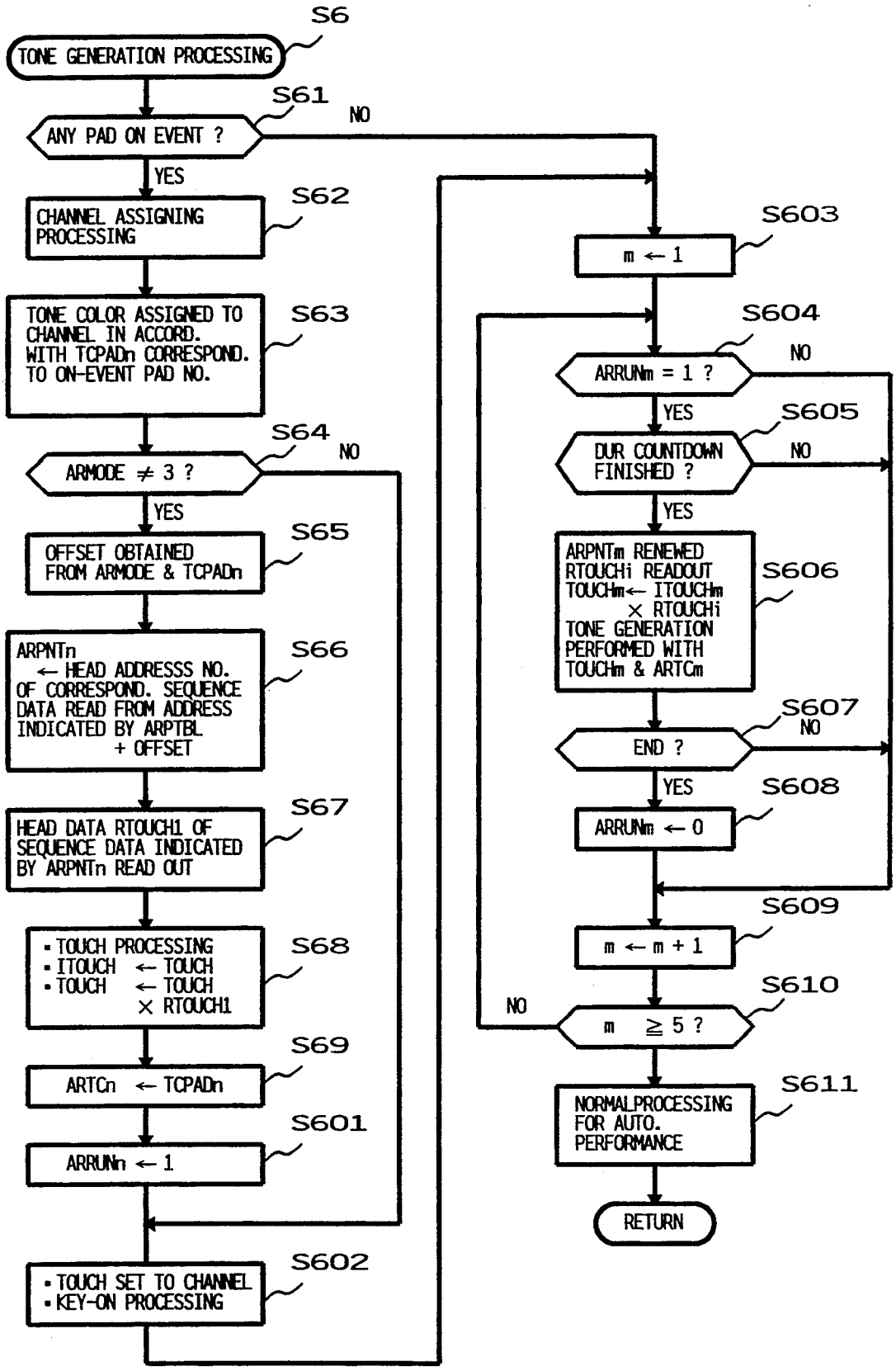
FIG. 12 is a flow chart of a specific example of tone generation processing in FIG. 8.

After completion of the pad tone color assigning processing, the automatic roll setting processing of FIG. 9 is performed in step S5, the tone generation processing of FIG. 12 is performed in step S6 and other processings are performed in step S7 and thereafter the processings of step S2 and subsequent steps are repeated.

In step S5 for performing the automatic roll setting processing of FIG. 9, the state of the flag FLG1 is judged and, when FLG1 is not 0, the routine proceeds to step S56, whereas when FLG1 is 0, the routine proceeds to step S52.

In step S52, the presence or absence of an on event in the automatic roll switch 22 (ARSW) is detected. When there is no on event, the routine returns to the main routine. When there is an on event of the automatic roll switch 22, an LED display corresponding to the current mode number of the register ARMODE is made in step S53 as was previously described with reference to FIGS. 3A–3D.

In step S54, DISPTIM is set to "1" and TIMCNT to "400". In step S55, MODECHG is set to "1" and FLG1 to "1" and then the routine proceeds to the main routine. The value of TIMCNT set in this processing is used for counting a time of 2 seconds by timer interruption, to be described later, in such a manner that MODECHG and FLG1 are reset upon elapse of 2 seconds without-operation of the automatic roll switch 22.

In step S56, the state of the flag FLG2 is detected and, when FLG2 is not 0, the routine proceeds to step S505. When FLG2 is 0, the state of the flag MODECHG is detected in step S57. When MODECHG is not 1, the routine returns to the main routine whereas when MODECHG is 1, the presence or absence of an on event in the automatic roll switch 22 is detected in step S58.

When there is no on event in step S58, the routine returns to the main routine. When there is an on event, "1" is added to the register ARMODE in step S59 and, in step S501, ARMODE and "03H" (hexadecimal notation of 8 bits) are ANDed, bit by bit, and the results are stored in the register ARMODE. By the processings of step S59 and step S501, the mode number of the register ARMODE circulates in the order of 0, 1, 3, 0.

Then, in step S502, an LED display corresponding to the mode number of the register ARMODE is made and, in step S503, DISPTIM is set to "1" and TIMCNT is set to "400". In step S504, MODECHG is set to "1" and FLG2 is set to "1" and the routine returns to the main routine. This flag FLG2 also is reset upon lapse of 2 seconds without operation of the automatic roll switch 22.

Then, in step S505, whether the automatic roll switch 22 is on or not is detected. When the switch 22 is not on, the routine proceeds to step S507 whereas when the switch 22 is on, state of the flag MODECHG is detected in step S506. When MODECHG is not 1, the processings of step S59 and subsequent steps in FIG. 9 are performed whereas when MODECHG is 1, the routine returns to the main routine.

In step S507, DISPTIM is set to "1" and TIMCNT is set to "400" and, in step S508, FLG1, FLG2 and MODECHG are reset to "0" and then the routine returns to the main routine.

As described above, in the automatic roll setting processing S5, the value of the timer counter TIMCNT is set to "400" and renewal and setting of the mode of roll, flam, echo or off and switching of display of the mode are made each time the automatic roll switch 22 is operated.

Figure 10:
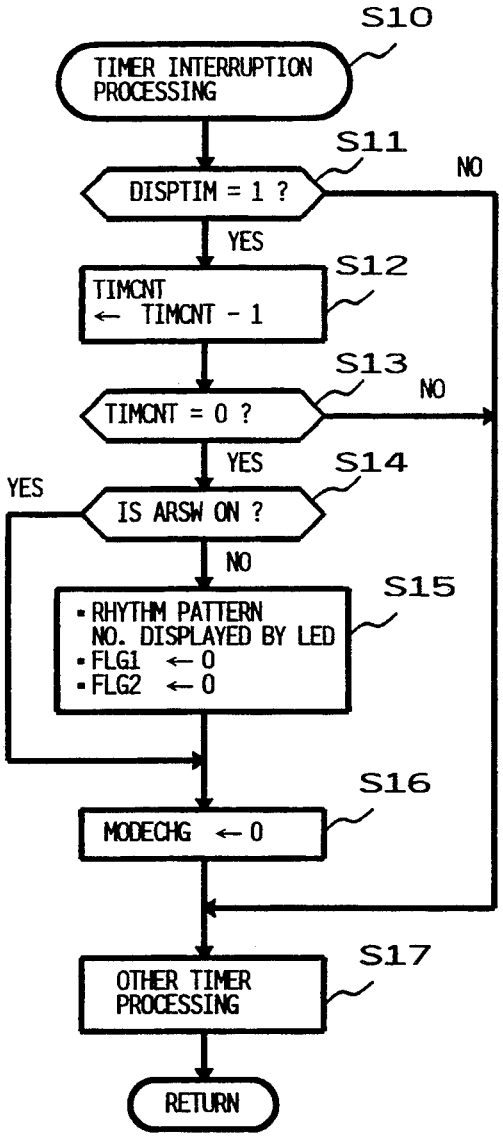
FIG. 10 is a flow chart of a timer interruption processing.

The timer interruption processing S10 in FIG. 10 is started at an interval of 5 msec as described above and, in step S 11, the state of the flag DSIPTIM is detected and, when DISPTIM is not 1, other timer processing is performed in step S17 and then the routine returns to the original routine whereas, when DISPTIM is 1, the timer counter TIMCNT is decremented in step S12, whether TIMCNT=0 or not is detected in step S13.

When TIMCNT is not 0 in step S13, other timer processing is performed in step S17 and the routine returns to the original routine. When TIMCNT is 0, whether the automatic roll switch 22 is on or not is detected in step S14. When the automatic roll switch 22 i s on, the routine proceeds to step S16 whereas when the automatic roll switch 22 is not on, in step S15, the pattern number of the currently selected rhythm pattern of the automatic performance is displayed by the LED and the flags FLG1 and FLG2 are reset and then the routine proceeds to step S16.

In step S16, the flag MODECHG indicating switching of the automatic roll mode is reset to "0" and, in step S17, other timer processing is performed and thereafter the routine returns to the original routine.

As described above, in the timer interruption processing S10, the value of the timer counter TIMCNT which is set to "400" by operation of the automatic roll switch 22 is decremented at an interval of 5 msec and, when the value of this timer counter TIMCNT is "0" and the automatic roll switch 22 is not on, the pattern number of the rhythm pattern is displayed.

More specifically, when 2 seconds have elapsed without operating the automatic roll switch 22, the kind of effect of the automatic roll mode or automatic roll off is set by the current mode number of the register ARMODE and the LED display is changed to display of the rhythm pattern.

By the automatic roll setting processing of FIG. 9 and the timer interruption processing of FIG. 10, upon depressing the automatic roll switch 22, a currently designated automatic roll mode, i.e., one of roll, flam, echo and off, is displayed and, upon lapse of 2 seconds, the display of the pattern number of the original rhythm pattern is restored. When the automatic roll switch 22 is depressed again before lapse of 2 seconds, the display is changed cyclically from the display of the automatic roll mode in the order of roll, flam, echo, off, roll . . . and, therefore, by stopping depression of the automatic roll switch 22 when a desired mode is displayed, the automatic roll mode is set to the mode which is displayed at this time point and, upon lapse of 2 seconds, the display is restored to the original display of the rhythm pattern number.

Figure 11:
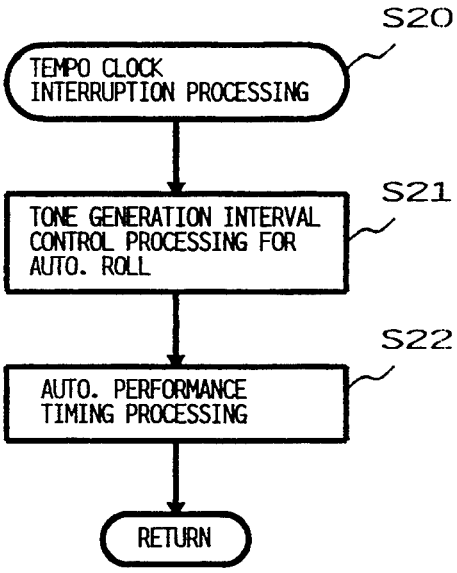
FIG. 11 is a flow chart of a tempo clock interruption processing.

In a tempo clock interruption processing S20 of FIG. 11, a tone generation interval control processing for controlling the interval of continuous beating in the automatic roll is performed on the basis of the duration data DUR and, in step S22, a conventional automatic performance timing processing is performed and thereafter the routine returns to the original routine.

As the tone generation interval control processing of step S21, a flag indicating tone generation interval is provided, for example, and, when this flag is in a reset state, duration data DUR is read from an address next to RTOUCHi of sequence data and the flag is thereby set. This duration data DUR is counted down each time interruption has occurred and when this value has become 0, the flag is reset and ending of countdown of the duration data is stored.

In a case where data read from an address next to RTOUCHi is the end data END, detection of ending is stored in a flag and sounding of repeated tones can be ended in the tone generation processing S6.

In the tone generation processing S6 of FIG. 12, the pad event buffer is referred to for detecting the presence or absence of a pad on event in step S61. When there is no pad on event, the routine proceeds to step S603. When there is a pad on event, processings of step S62 and subsequent steps are performed.

In step S62, a processing for assigning a channel in the tone generation section 8 is performed. In step S63, a pad number n of a pad in which a pad on event has occurred and initial touch TOUCH are read out and a tone color is assigned to a channel in accordance with TCPADn corresponding to the pad number n.

Then, in step S64, whether ARMODE is 3 or not is detected. When ARMODE is 3, the mode is automatic mode off and, therefore, the routine proceeds to step S602 whereas when ARMODE is not 3, processings of step S65 and subsequent steps are performed.

In step 65, the relative address number OFFSET of the automatic roll sequence address table is obtained by combining ARMODE and TCPADn as was previously described with reference to FIG. 7. In step S66, a head address number of corresponding sequence data is read from the address indicated by the data APRTBL+OFFSET and stored in ARPNTn.

Then, in step S67, head data RTOUCH1 of the sequence data indicated by ARPNTn is read out and, in step S68, initial touch TOUCH is stored in ITOUCH and a value obtained by multiplying RTOUCH with TOUCH is stored in TOUCH. In other words, the tone volume of the first tone is set to a value corresponding to initial touch during a pad on event.

Upon completion of the touch processing in step S68, the tone color number TCPADn is stored in ARTCn in step S69. In step S601, an automatic roll start flag ARRUNn is set to "1" and, in step S602, touch data TOUCH is set to a channel in the tone generation section 8 and a key-on processing in accordance with a tone color of the tone color number TCPADn is performed.

By the above described steps S62 through S602, tone generation of the first tone during the pad on event is made and a processing for a second tone and subsequent tones is performed from step S603.

In step S603, "1" is set to a variable m representing a pad number and, between this step S603 and step S609 in which m is incremented and step S610 in which a judgment is made, processings from step S604 to step S609 are repeated with respect to pad numbers of four pads 1.

In step S604, whether ARRUNn is 1 or not is detected. When ARRUNn is not 1, the routine proceeds to step S609 and when ARRUNn is 1, processings of step S605 and subsequent steps are performed. In step S605, whether countdown of the duration data DUR has finished or not is detected by a tempo clock interruption processing. When the countdown has not finished yet, the routine proceeds to step S609 whereas when the countdown has finished, processings of step S606 and subsequent steps are performed for making the next tone generation.

In step S606, the address number ARPNTm is renewed and sequence data RTOUCHi is read out. A value obtained by multiplying RTOUCHi with ITOUCH is stored in TOUCH and tone generation is performed with the tone volume this TOUCH and tone color of the tone color number ARTCm.

Then, in step S607, whether the end data of sequence data has been detected or not is judged. When the end data has not been detected, the routine proceeds to step S609 whereas when the end data has been detected, the automatic roll start flag ARRUNm is reset to "0" in step S608 and then the routine proceeds to step S609.

After repeating the above described processings with respect to the respective pad numbers, the routine proceeds from step S610 to step S611 in which other normal processings for automatic performance are performed. Then, the routine returns to the main routine.

In the above described manner, the processings of steps S604 through S610 correspond to performance of the stroke pattern of roll performance, flam performance or echo. Since sequence data for the processings is read by an address number corresponding to the tone color number TCPADn which is set to the n-th pad 1, tone generation is made with a stroke pattern matching with each tone color.

In the above described embodiment, the repeated-tone modes consists of three modes of roll, flam and echo. The repeated-tone mode however is not limited to these but it may consists of four or more modes or only one mode. A repeated-tone mode may be selected not by a switch operation but in accordance with the strength of a pad operation touch. When, for example, a pad has been operated with a strength exceeding a predetermined strength, roll performance may be automatically started. In accordance with the strength of a pad operation touch, not only a tone volume control of a generated tone and automatic selection of the repeated-tone mode are performed but also tone generation tempo of continuous beat tones may be automatically controlled.

As described in the foregoing, according to the invention, the electronic musical instrument comprises plural performance operators such as pads and stores tone color information representing plural tone colors of rhythm tones and plural stroke pattern information about roll performance etc. corresponding to the tone color information, the tone color information and the stroke pattern information corresponding to this tone color information is set to the performance operators and, by operation of one of the performance operators, a tone is generated with a tone color and continuous beat pattern set to this performance operator. Accordingly, a performance effect by repeated tones of a percussion instrument which corresponds to each of plural tone colors such as those of rhythm tones of a drum set can be obtained.

We claim:

1. An electronic musical instrument comprising:

a plurality of performance operators;

memory means storing stroke pattern information in correspondence to plural rhythm instrument tone colors, each of said performance operators being assigned to one of the plural rhythm instrument tone colors; and tone signal generation means responsive to operation of any of said performance operators, for reading from said memory means stroke pattern information corresponding to a tone color assigned to the any of said performance operators and generating a tone signal having the tone color assigned to the any of said performance operators with a stroke pattern corresponding to the read out stroke pattern information.

2. An electronic musical instrument as defined in claim 1, wherein said tone signal generation means generates the tone signal with a tone color and a stroke pattern which differ depending on which of said plurality of performance operators is operated.

3. An electronic musical instrument as defined in claim 1, which further comprises tempo setting means for setting a tempo of performance and wherein said tone signal generation means generates the tone signal in accordance with the tempo set by said tempo setting means.

4. An electronic musical instrument as defined in claim 1, wherein said memory means stores plural stroke patterns and said tone signal generation means includes means for selecting a stroke pattern corresponding to a tone color of a tone to be generated and reading out said selected stroke pattern from said memory means.

5. An electronic musical instrument as defined in claim 1, which further comprises mode selection means for selecting one repeated-tone mode from among repeated-tone modes and wherein said tone signal generation means generates the tone signal in accordance with a continuous beat pattern which is determined by the continuous beat mode selected by said mode selection means and a tone color of a tone to be generated.

6. An electronic musical instrument as defined in claim 5, which further comprises display means for displaying the repeated-tone mode which has been selected by said selection means.

7. An electronic musical instrument as defined in claim 1, wherein said tone signal generation means comprises means for detecting strength of operation of any of said performance operators, said tone signal generation means controlling the stroke pattern in response to detected strength of operation.

8. An electronic musical instrument as defined in claim 1, wherein said stroke pattern information includes information representing a tone generation timing and tone volume of each repeated tone, and the tone generation timing or tone volume of each repeated tone differs from that of other repeated tones in correspondence to a tone color.

9. An electronic musical instrument as defined in claim 1, wherein each of said plurality of performance operators is a pad type operator.

10. An electronic musical instrument as defined in claim 1, further comprising:

assigning means for assigning said one of said plural rhythm instrument tone colors to each of said performance operators.

* * * * *